United States Patent [19]

Irpola

[11] 4,192,080

[45] Mar. 11, 1980

[54] METHOD OF OBTAINING AN EVEN MOISTURE PROFILE IN A CYLINDER DRIER AND A MEANS FOR CARRYING OUT THE METHOD

[76] Inventor: Eero A. Irpola, Tuureporinkatu 13 E, SF-20100 Turku 10, Finland

[21] Appl. No.: 868,753

[22] Filed: Jan. 12, 1978

[30] Foreign Application Priority Data

Feb. 4, 1977 [FI] Finland ..... 770385

[51] Int. Cl.[2] ..... F26B 3/24

[52] U.S. Cl. ..... 34/41; 34/110; 34/124; 29/110; 100/93 RP; 156/215; 165/89

[58] Field of Search ..... 165/89, 146, 185; 432/10, 60, 253, 255.1; 34/119, 124, 41, 110; 29/110, 118, 119; 100/93 RP; 219/10.49 A, 469; 162/375, 378, 379, 207; 156/215; 428/35, 192

[56] References Cited

U.S. PATENT DOCUMENTS

| | | | |
|---|---|---|---|
| 907,829 | 12/1908 | Macadam | 29/119 |
| 3,401,439 | 9/1968 | Staats et al. | 219/469 |
| 3,600,550 | 8/1971 | Katsumata | 219/469 |

*Primary Examiner*—Larry I. Schwartz
*Attorney, Agent, or Firm*—McGlew and Tuttle

[57] ABSTRACT

A method of improving the drying characteristics of a cylinder drying section of a paper or a cardboard machine so that an essentially even transverse moisture profile of the dried paper or cardboard web is achieved by this drier comprises coating the rim areas of the outer jacket surface of at least some of the drying cylinders with a heat-insulating foil.

5 Claims, 1 Drawing Figure

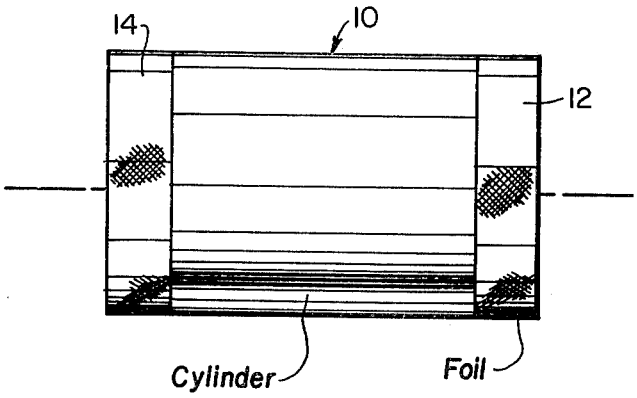
14
10
12
Cylinder
Foil

METHOD OF OBTAINING AN EVEN MOISTURE PROFILE IN A CYLINDER DRIER AND A MEANS FOR CARRYING OUT THE METHOD

BACKGROUND OF THE INVENTION

1. Field of the Invention

This invention relates, in general, to paper or cardboard machines and, in particular, to a new and useful method of improving the drying characteristics of the cylinder drying section of such machine.

2. Description of the Prior Art

A very important drawback in cylinder driers for paper and cardboard is the tendency of the paper of cardboard web to dry more at the edges than at the middle of the web. This uneven transverse moisture profile remains also in the finished product and causes considerable disadvantages in the subsequent treatment of the product.

The fast drying tendency of the border area is especially pronounced in high speed machines for drying thick webs wherein the temperature of the cylinder is kept high in order to achieve a sufficient drying of the web. One reason for this inconvenience is the hot border area of the cylinder will not be covered by a cooling paper web as under normal circumstances the width of the paper web does not extend over the whole length of the cylinder but uncovered narrow free edge strips remain at the ends of the cylinder. In this case the free edge strip will act as a heating rib promoting the drying of the paper at its border areas. The drying effect at the border area is further enhanced by the fact that the heating steam is often fed into the drying cylinder close to end thereof.

In order to eliminate the problems connected with excess drying of the border area, solutions have been proposed as regards the drying cylinder as well as the drying process. The solutions as regards the drying cylinder have aimed at changing the surface temperature of the cylinder so as to cool the border parts with respect to the middle part of the cylinder surface. In order to achieve this an insulating layer has been built inside the cylinder jacket covering the border areas. In some cases the cylinder jacket has been made thicker at its borders as compared to the middle part. One solution consists in boring cavities on the inside of the cylinder jacket into which are inserted bodies of a material having better thermal conductivity characteristics than the jacket material. If a greater number of these well conducting bodies are inserted at the centre of the cylinder than at the borders, this naturally leads to a temperature rise at the center part of the jacket as compared to the temperature at the borders, which affects the moisture profile advantageously. Further a cylinder construction has been proposed wherein the cylinder is divided longitudinally into separate heating compartments having separate inlets for the heating steam and corresponding condensate outlets.

By means of all the above mentioned cylinder construction solutions naturally the transverse moisture profile may be adjusted but it has not been possible to correct the profile completely except in some rare exceptional cases. It is further to be observed that the cylinders in the proposed solutions require fairly expensive special constructional arrangements which irrespective of their high costs do not function completely satisfactorily.

One possiblility exhibiting several different alternatives resides in attempting to affect the drying process from the outside of the cylinder and to dry the paper or the board web evenly in the crosswise direction. Solutions of this kind are offered especially by the different blowing and conducting systems for the drying air, by means of which the drying air is distributed differently towards different areas of the web, or by means of which moist air is withdrawn from the spaces between the cylinders. These solutions always require extremely expensive additional equipment the performance of which by no means is satisfactory the moisture profile still remaining uneven, i.e. the web tends to dry more at its edges than at its middle.

SUMMARY OF THE INVENTION

Surprisingly it has been found according to the invention that if the border areas of the outer surface of the drying cylinder i.e. a part of the cylinder jacket extending some distance from both cylinder ends is covered by a suitable heat insulating material, a substantial evening out of the moisture profile of the web is achieved and in some cases a completely even moisture profile is obtained over the whole width of the web.

Accordingly, it is an object of the invention to provide a method of improving the drying characteristics of the cylinder drying section of a paper or cardboard machine so that an essentially even transverse moisture profile of the dried paper or cardboard web is achieved by this drier comprises coating of the rim areas of the outer jacket surface of at least some of the drying cylinders with a heat insulating foil.

For an understanding of the principles of the invention, reference is made to the following description of typical embodiments thereof as illustrated in the accompanying drawings.

BRIEF DESCRIPTION OF THE DRAWINGS

In the Drawings:

The only FIGURE of the drawings is a front elevational view of a cylinder or a drying section of a paper or cardboard machine constructed in accordance with the invention.

GENERAL DESCRIPTION OF THE PREFERRED EMBODIMENT

Referring to the drawing, in particular, the invention embodied therein comprises a method of improving the drying characteristics of the cylinder, drying section of a paper or cardboard machine which includes a cylinder generally designated 10, of a paper or cardboard machine having end areas or end rim areas 12 and 14 which are coated with a foil material of heat-insulating characteristics. The heat-insulating foil is from 0.8 to 2.1 meters in width, depending on the temperature of the cylinder 10 which is covered. The foil advantageously comprises a glass fiber fabric covered on both sides with a polytetrafluoroethylene. The foil may also comprise 40 percent glass fiber fabric and 60 percent of polytetrafluoroethylene, the thermal conductivity of the foil thus being from 0.27 to 0.28 Kcal/hr m° C. The thickness of the foil is from 0.15 to 0.3 mm.

The covering material should naturally fulfil certain requirements firstly as regards the right thermal conductivity so as to obtain a sufficiently thin layer on the surface of the cylinder. Secondly, the material should withstand the temperature conditions of the cylinder jacket as well as the centrifugal forces due to the rotational movement. According to tests a polytetrafluorethylene foil strengthened with a glass fiber fabric has proven suitable for this purpose. The polytetrafluorethylene and the glass fiber fabric form a rigid structure, i.e. the fabric is completely covered by PTFE the amount of PTFE being advantageously about 60%. The thermal conductivity of pure polytetrafluorethylene is about 0.21 kcal/h m° C. but the glass fiber fabric somewhat reduces the insulating capacity of the foil structure and the thermal conductivity of the foil will thus be about 0.27–0.28 kcal/h m° C.

A suitable thickness of PTFE-glass fiber fabric is about 0.25 mm and most advantageously about 0.3 mm. Usually thicker PTFE-glass fiber fabric is used on the forepart cylinders in the drier and a thinner material thickness at the end and in some cases it is possible to use a material thickness less than 0.25 mm for the PTFE-glass fiber fabric.

The PTFE-glass fiber fabric is advantageously fastened to the cleaned cylinder surface with glue, advantageously included already into one of the surfaces of the PTFE-glass fiber fabric and covered with a protecting layer.

The width of the covering strip depends on the temperature and the length of the cylinder and is normally between 0.8 to 1.5 m, whereby in high temperature cardboard cylinder driers, exhibiting a temperature sometimes over 300° C., the maximum distance, i.e. about 1.5 to 2.0 m of the cylinder jacket is covered starting from the ends. According to tests a quite substantial improvement in the transverse moisture profile of the web to be dried has thus been achieved. This is an evident result of the evening out of the surface temperatures of the cylinder jacket achieved with the insulating means according to the invention.

The evening out of the moisture in the crosswise direction has been so remarkable that the need for the above mentioned air blowing devices becomes questionable, and if the devices in question may be eliminated this naturally means substantial savings in the construction and use of the drying sections in paper and cardboard machines.

It is also to be noted that the invention is very easily adaptable to already existing drying cylinders and no structural changes need to be made to these.

I claim:

1. Method to improve the drying characteristics of the cylinder drying section of a paper or cardboard machine so that an essentially even transverse moisture profile of the dried paper or cardboard web is achieved by this dryer, the improvement comprising coating of the rim areas of the outer jacket surface of at least some of the drying cylinders with a heat insulating foil.

2. The method of claim 1, wherein the width of the areas of the cylinder jackets covered with the heat insulating foil is 0.8 to 2.0 m, depending on the temperature of the cylinder covered.

3. The method of claim 1, wherein the foil consists of a glass fiber fabric covered on both sides with polytetrafluoroethylene.

4. The method of claim 1, wherein the foil consists of 40% glass fiber fabric and of 60% of polytetrafluoroethylene, the thermal conductivity of the foil thus being 0.27 to 0.28 Kcal/hr m° C.

5. The method of claim 4, wherein the thickness of the foil is 0.15 to 0.3 mm.

* * * * *